United States Patent [19]

Thiermann, Sr.

[11] 4,362,451

[45] Dec. 7, 1982

[54] POLE-SETTING APPARATUS

[75] Inventor: William E. Thiermann, Sr., Mequon, Wis.

[73] Assignee: Racine Federated Inc., Racine, Wis.

[21] Appl. No.: 180,862

[22] Filed: Aug. 25, 1980

[51] Int. Cl.[3] ..... B66F 11/02

[52] U.S. Cl. ..... 414/23; 280/404; 403/353; 403/376

[58] Field of Search ..... 414/10, 23, 680, 745, 414/754, 783, 731; 280/404; 403/353, 376, 380

[56] References Cited

U.S. PATENT DOCUMENTS

| | | | |
|---|---|---|---|
| 2,570,933 | 10/1951 | Fobes et al. | 403/376 X |
| 3,112,037 | 11/1963 | Thiermann | 414/23 |
| 3,154,200 | 10/1964 | Versch et al. | 414/23 |
| 3,161,301 | 12/1964 | Versch | 414/23 |
| 3,236,398 | 2/1966 | Thiermann | 414/23 |
| 3,315,976 | 4/1967 | Thiermann | 280/103 |

FOREIGN PATENT DOCUMENTS

| | | | |
|---|---|---|---|
| 174864 | 5/1953 | Austria | 414/731 |
| 62562 | 6/1925 | Sweden | 280/404 |
| 819601 | 9/1959 | United Kingdom | 403/376 |

*Primary Examiner*—Leslie J. Paperner

*Attorney, Agent, or Firm*—Wegner, McCord, Wood & Dalton

[57] ABSTRACT

A pole-setting apparatus for raising a pole from a horizontal position and setting it in a vertical position in a hole and having a boom assembly extended between a ground-engaging dolly and a cradle-support structure, with a cradle frame pivotally mounted between its ends to the cradle-support structure, a single binder member for holding a pole in association with the cradle frame throughout manipulation of the pole, a single hydraulic cylinder connected between the cradle-support structure and the cradle frame for causing relative movement therebetween, and a quick-connection structure for pivotally connecting the boom assembly to the ground-engaging dolly.

7 Claims, 6 Drawing Figures

POLE-SETTING APPARATUS

BACKGROUND OF THE INVENTION

This invention pertains to pole-setting apparatus for transporting a utility pole to the desired location and, thereafter, lifting the pole and setting the pole into a hole.

Frequently, a pole must be set into a hole in upright position at a location not accessible to large truck or tractor-mounted power equipment, or where use of such equipment would damage the surrounding terraine. A pole-setter, which may be moved easily into position, has been in use for many years and is of a type shown in Thiermann U.S. Pat. No. 3,112,037 wherein a boom assembly is removably connected to a dolly with ground-engaging tires and the boom assembly mounts a pivoted cradle whereby activation of a pair of hydraulic cylinders causes pivoting of the cradle to elevate a pole and, at the same time, the dolly advances along the ground and with there being a coaction of the parts, as set forth in the aforesaid patent, until the pole is firmly positioned in the hole. A variation of the pole-setter is shown in Thiermann U.S. Pat. No. 3,236,398.

In the foregoing devices, it has been conventional to use two binder members for holding a pole in association with the cradle during elevation and setting of the pole and with pivoting of the cradle being accomplished by operation of a pair of hydraulic cylinders. This construction has been more expensive and relatively complex because of the need for two hydraulic cylinders with additional connections and with additional time involved in use of the pole-setter because of the need for attaching and releasing the pair of binder members.

Additionally, the first-mentioned patent shows a pivotal connection between the boom assembly and the dolly by means of a pivot pin which permits pivoting of the parts relative to each other. The connection is difficult to make, since it requires accurate alignment of openings in the parts to be connected prior to insertion of the pivot pin therethrough.

SUMMARY OF THE INVENTION

A primary feature of the invention is to provide a pole-setting apparatus which is of improved construction to simplify use thereof in setting of a pole and which has structural features providing for improved interconnection of parts and adjustment thereof as well as simplifying and reducing the number of parts involved.

In carrying out the foregoing, the pole-setting apparatus has a boom assembly connected to a ground-engaging dolly at one end and, at the other end, having a cradle-support structure which pivotally mounts a cradle operable by a single hydraulic cylinder connected between the cradle-support structure and the cradle frame. The cradle frame has upwardly and outwardly diverging inner and outer pole supports positioned one at each end thereof and with a single binder member for holding a pole disposed on said cradle frame and spaced at unequal distances from said pole supports whereby the binder member and the pole supports at an inner end of the cradle frame provide a major lever arm for exerting forces on the pole during pole-setting. The binder member and the pole supports at the outer end of the cradle frame provide a minor lever arm to prevent fall out of the pole from the cradle frame as the pole approaches an upright position.

Additionally, the boom assembly and ground-engaging dolly are interconnected by quick-connection means which facilitates connection of the boom assembly to the dolly as well as permitting pivoting therebetween during pole-setting. The quick-connection means includes a pin and hook connection between the boom assembly and dolly as well as a pin and slot connection therebetween with shaping of the slot to enable easy pin insertion and permit pivoting between the parts.

DESCRIPTION OF THE PREFERRED EMBODIMENT

Figure 1:
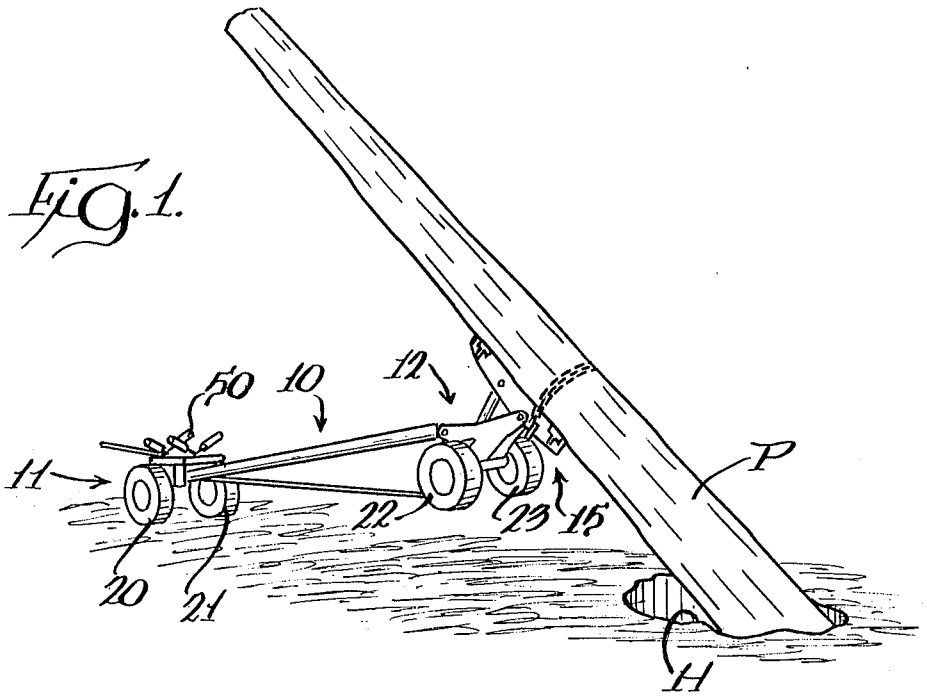
FIG. 1 is a perspective view, showing the pole-setting apparatus in one position thereof during setting of a pole.

The pole-setting apparatus is composed of a number of primary components including a boom assembly, indicated generally at 10, which is associated, at one end thereof, with a ground-engaging dolly and, at its other end, with a cradle-support structure, indicated generally at 11 and 12, respectively. The cradle-support structure rotatably mounts a cradle assembly, indicated generally at 15.

The dolly 11 mounts ground-engaging tires 20 and 21 and the cradle-support structure 12 has ground-engaging tires 22 and 23 whereby the apparatus can be moved to a position adjacent a hole H which is to receive the pole P. Generally, the structure of the dolly 11 is that shown in Thiermann U.S. Pat. No. 3,315,976 and the structure disclosed therein is incorporated herein by reference. The dolly has a cross frame member 25 which mounts the tires 20 and 21 for steering adjustment about a pair of vertical axes defined by pintles 26 and 27 rotatably mounted in bearings 28 and 29 carried by the cross frame member and which extend upwardly from a pair of frame members 30 and 31 which have outwardly-extending axles at their lower ends for rotatably mounting the tires. As seen particularly in the Thiermann U.S. Pat. No. 3,315,976 patent, the dolly can be steered by movement of the tires 20 and 21 about their vertical axes by structure operable from a handle 35 which fits into a socket 36 carried by a link 37. The link 37 is pivoted by a pin 38 to a bracket 39 affixed to a tubular member 40 mounted on the cross frame member 25 and is pivotally connected by a pin 41 to a generally U-shaped steering bar 42. The steering bar 42 extends to pivot connections with the ends of a pair of arms extending outwardly from the frame members 30 and 31 and with these arms corresponding to the arms 21 in the last-mentioned patent. Rotation of the handle 35 about the pivot pin 38 causes shift of the steering bar 42 with resultant pivoting of the tire-supporting frames 30 and 31 for direction control of the dolly during movement thereof along the ground.

The cross frame member 25 has the tubular opening 40 to receive a downwardly-extending post 45 which extends from the underside of a frame 46 which mounts two spaced-apart pairs of upwardly and outwardly diverging rollers for movably supporting the pole P. A first pair of rollers 47 and 48 is located at one end of the frame 46, while the second pair of rollers 49 and 50 is located at the other end of the frame 46. A binder chain 51 is removably attachable to the frame 46 and variable in length to hold a pole P in association with the frame 46 during transport of the pole to the site but, thereafter, is removed to permit movement of the pole relative to the dolly frame.

The boom assembly 10 includes a tubular boom 55 and a torsion bar 56. One end of the boom and torsion bar are releasably connected to the cradle-support structure 12. The opposite end of the torsion bar is welded to the boom near its opposite end and, more particularly, to a connecting plate 57 welded to an end of the boom and having part of quick-connection means for connecting the boom assembly to the ground-engaging dolly 11.

Figure 2:
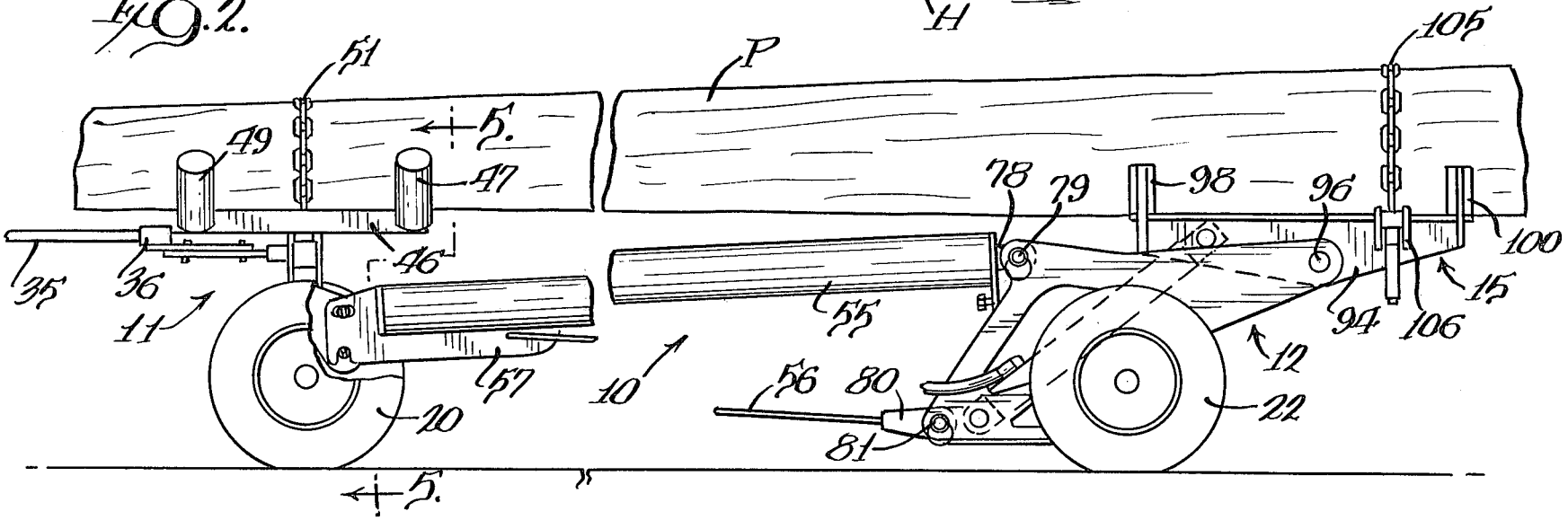
FIG. 2 is a fragmentary, side elevational view of the pole-setting apparatus with parts broken away.
Figure 3:
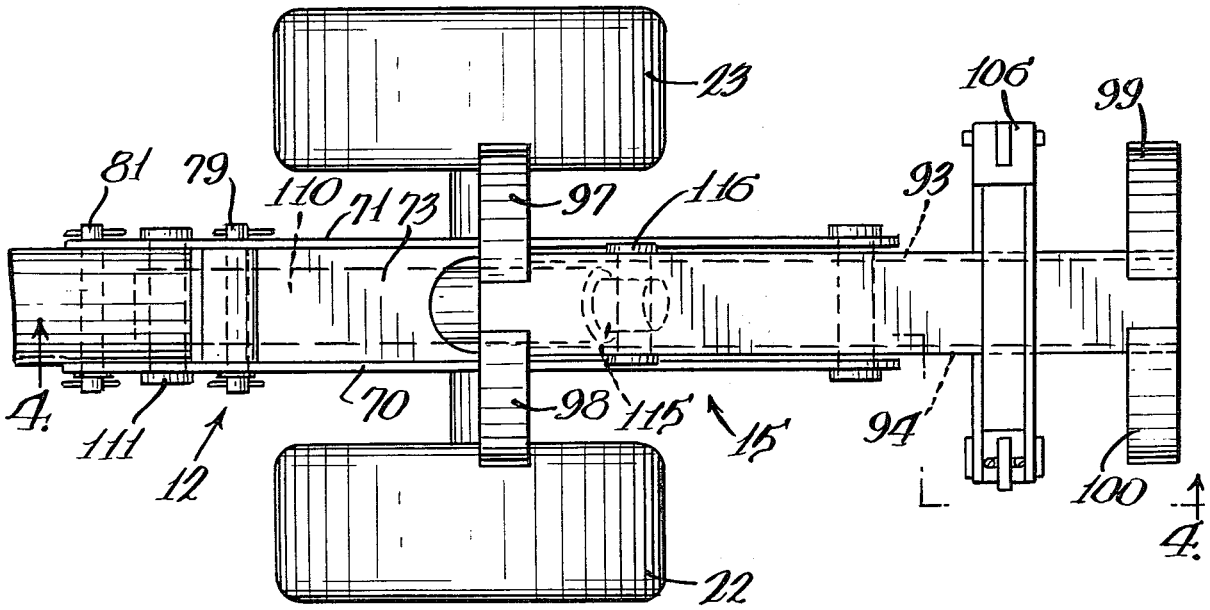
FIG. 3 is a fragmentary, plan view of the cradle assembly and cradle-support structure.
Figure 4:
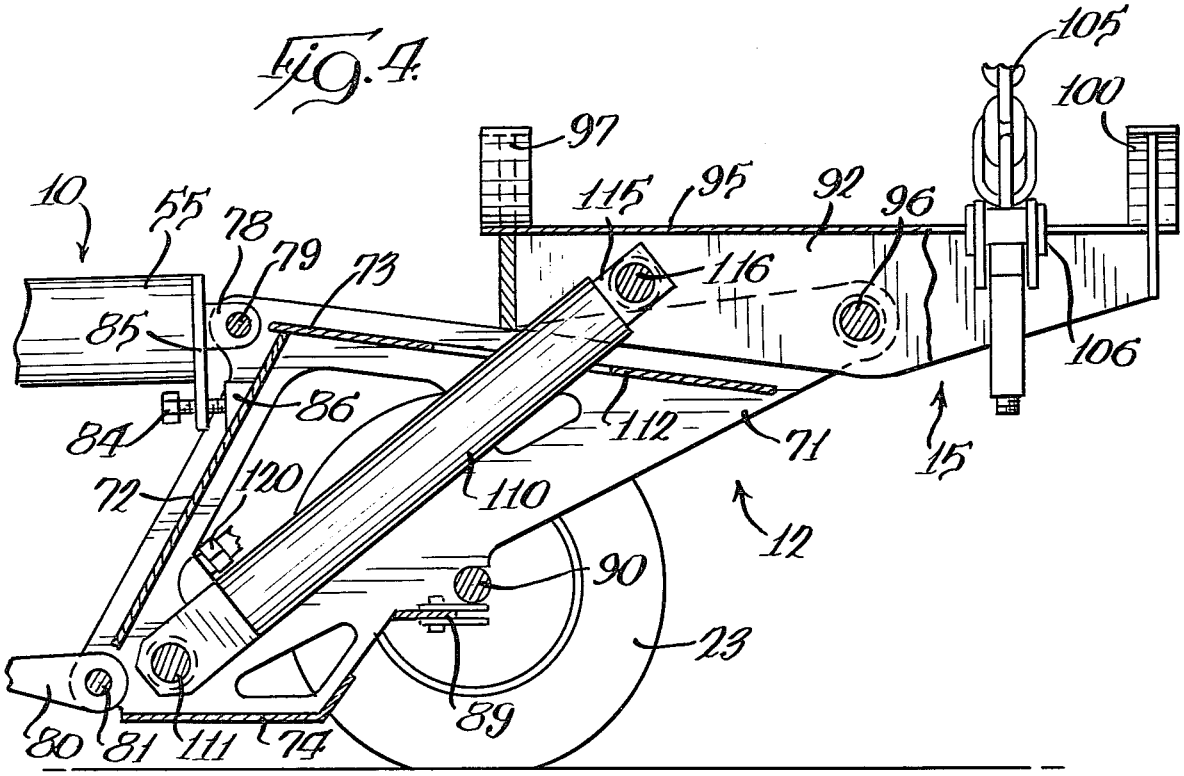
FIG. 4 is a vertical section, taken generally along the line 4—4 in FIG. 3.
Figure 5:
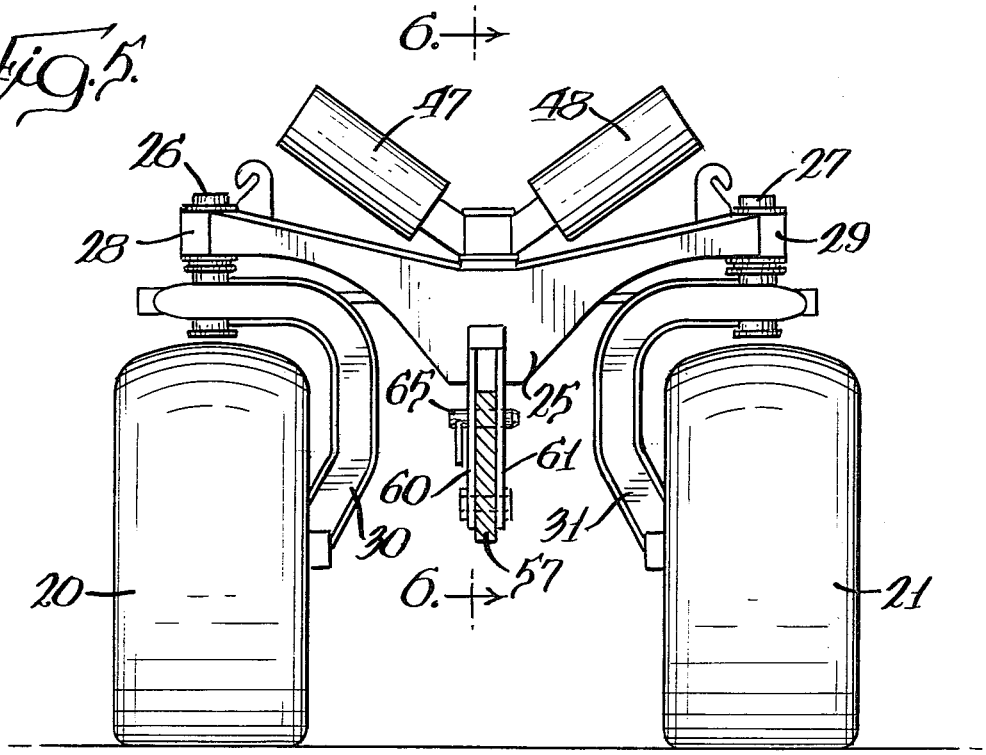
FIG. 5 is a vertical section, on an enlarged scale, taken generally along the line 5—5 in FIG. 2 and with the pole omitted.
Figure 6:
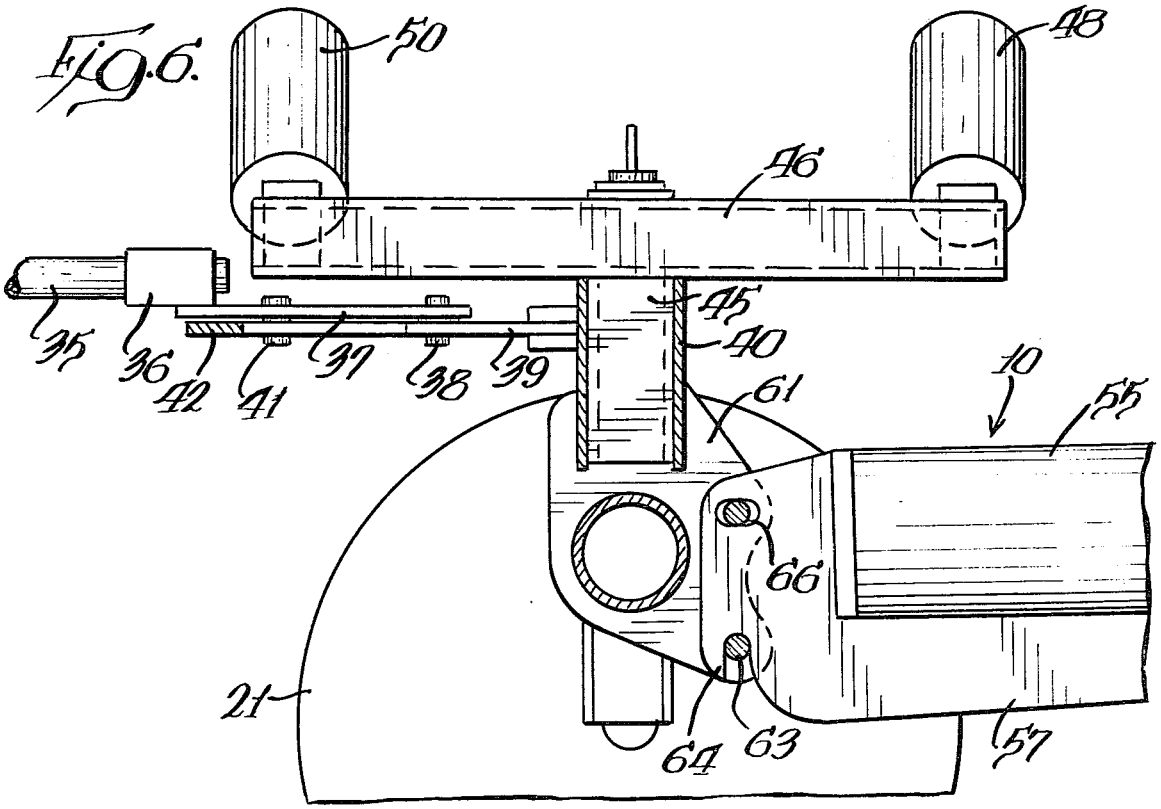
FIG. 6 is a vertical section, on a further enlarged scale, and taken generally along the line 6—6 in FIG. 5.

The quick-connection means is shown particularly in FIGS. 2, 5 and 6 and includes a pair of spaced-apart plates 60 and 61 secured to the dolly cross frame member 25 and which receives the connecting plate 57 therebetween. A first pin 63 extends between the plates 60 and 61 and is fixed thereto for coaction with a hook 64 formed on a connecting plate 57. A second pin 65 is removably secured by a cotter pin and extends through aligned openings in the plates 60 and 61 and also through an opening 66 in the connecting plate 57, with the latter opening being elongate in a direction normal to a radian from the fixed pin 63. In order to disassemble the structure, the pin 65 is removed and then the boom 55 can be raised to remove the hook 64 from the fixed pin 63. When it is desired to assemble the boom to the dolly, it is only necessary to move the connecting plate into position to generally align the hook 64 with the fixed pin 63 and the parts can then be meshed together, followed by insertion of the pin 65, with this positioning facilitated by the elongated opening 66 and with this latter opening permitting pivoting of the dolly frame relative to the boom during pole setting.

The cradle-support structure 12 includes a pair of spaced-apart side plates 70 and 71 which are interconnected by a series of planar members 72, 73, and 74 spanning the distance between the plates and welded thereto to form a rigid structure.

The cradle-support is releasably connected to the boom assembly by releasable connection of both the boom 55 and the torsion bar 56 thereto. The boom 55 has an apertured ear 78 extending therefrom which aligns with openings formed in ears in the side plates 70 and 71 to receive a removable pin 79 which can be held in position by a cotter pin. The torsion bar 56 has an enlarged end 80 formed with an aperture to receive a similar removable pin 81 which extends through openings in the side plates 70 and 71. After connection of the boom 55 and torsion bar 56 to the cradle-support structure, the torsion bar can be tensioned by operation of a tension-setting bolt 84 which threads into a plate 85 fixed to the end of the boom and abuts against a bolt stop 86 on the cradle-support structure intermediate the connections of the boom and torsion bar to the cradle-support structure. As the tension-setting bolt 84 is advanced outwardly of the mounting plate 85, a force is exerted against the bolt stop 86 exerting a counterclockwise rotational force on the cradle-support structure which increases tension on the torsion bar 56.

The side plates 70 and 71 of the cradle-support structure are generally triangular in shape and are provided intermediate their length along one edge thereof with support structure 89 for the axle 90 for the ground-engaging wheels 22 and 23.

The cradle assembly 15 includes a cradle frame 92 having a pair of side plates 93 and 94 interconnected by a top plate 95. The cradle frame is pivotally connected to the cradle-support structure by a pivot pin 96 which extends through the side plates 93 and 94 of the cradle frame as well as the side plates 70 and 71 of the cradle-support structure. The opposite ends of the cradle frame are provided with upwardly and outwardly diverging pole supports, with there being an inner pair 97 and 98 and an outer pair 99 and 100. During transport, as well as lifting of the pole, the pole P engages the inner and outer pairs of pole supports and is held thereagainst by a single binder member, in the form of a chain 105, which is pivotally mounted in a fixed position to a bracket 106 at one side of the cradle frame and which can extend around a pole to engage releasably with an attaching member 106 at the other side of the cradle frame. The binder member is located in a position to accomplish two different results in association with the pole supports of the cradle frame and which have previously been accomplished by two binder members associated one with each of the pairs of pole supports. The binder member is at unequal distances from the pairs of pole supports and is substantially closer to the outer pair of pole supports 99 and 100. In this location, the binder member provides a major level arm with the inner pole supports 97 and 98 whereby there is effective holding of the pole P in the cradle frame as the pole-setting apparatus moves to and beyond the position shown in FIG. 1 to move the butt end of the pole P into the hole H. As the poles move to an upright position, there is a relatively short lever arm between the binder member 105 and the pole supports 99 and 100 which is adequate to prevent fall over or fall out of the pole P from the cradle frame 15.

The cradle 15 is pivoted by means of a single hydraulic cylinder 110 positioned within the frame of the cradle support structure 12 and pivoted at its lower end by a pin 111 to the side plates 70 and 71 and extending upwardly through an opening 112 in the interconnecting frame member 73. The piston rod 115 of the hydraulic cylinder is connected to the cradle frame by a pin 116 extended between the cradle frame side plates 93 and 94. The construction of the cradle support structure 12 positions the cradle assembly 15 beyond the end of the boom 55 and provides a space for location of the hydraulic cylinder 110 in the same plane as the boom whereby the cradle frame can be pivoted by means of a single hydraulic cylinder which is substantially enclosed within the cradle frame structure. The hydraulic cylinder is under the control of a separate fluid power source which may be connected thereto by a quick-connect coupling 120.

The general operation of the pole-setting apparatus is as described in Thiermann U.S. Pat. No. 3,112,037 and the description therein is incorporated herein by reference. Generally, with the pole P connected to the dolly 11 and the cradle assembly 15, as shown in FIG. 2, the apparatus is moved to the location of the hole H and at a distance therefrom to provide a free length of pole for movement into the hole H. The binder member 51 on the dolly is then released and the hydraulic cylinder 110 is actuated to extend the piston rod 115 which pivots the cradle assembly 15 to insert the butt end of the pole into the hole H. Upon further extension of the piston rod, the tires 22 and 23 of the cradle-support structure leave the ground and the dolly moves forward toward the hole as the pole moves toward upright position in the hole.

The quick-connection means between the dolly 11 and the boom assembly 10 are off-center of the axles of wheels 20 and 21 whereby exertion of force at the quick-connection means by the boom assembly causes a tilt of the dolly to lift the handle 35 away from the ground.

Thereafter, the piston rod 115 is gradually retracted by releasing the hydraulic pressure periodically from the hydraulic cylinder to let the pole P descend into the hole. The single binder member 105 can then be released and the apparatus withdrawn.

I claim:

1. A pole-setting apparatus for raising a pole from a horizontal position into a vertical position in a hole and having a boom assembly extended between a ground-engaging dolly and a cradle-support structure, a cradle assembly including a cradle frame pivotally-mounted between its ends to said cradle-support structure, extensible hydraulic means connected between said cradle-support structure and said cradle frame for causing rotation of the cradle frame, a pair of upwardly and outwardly diverging inner and outer pole supports positioned one at each end of the cradle frame for support of a pole extending horizontally and longitudinally of the cradle frame, and a single binder member carried by the cradle frame for wrap around a pole to hold the pole and cradle frame in fixed relation, said binder member being unequally spaced from said pole supports and closer to said outer pole support to provide a major lever arm in association with the inner pole support during pole setting and a minor lever arm with said outer pole support to prevent fall out of a pole from the cradle frame as the pole approaches an upright position.

2. A pole-setting apparatus as defined in claim 1 wherein said binder member is a chain adjustably connectable to said cradle frame.

3. A pole-setting apparatus as defined in claim 1 wherein said cradle-support structure supports said cradle frame at a distance from the nearest end of the boom assembly, and said extensible hydraulic means comprises a hydraulic cylinder in the plane of said boom assembly and pivotally-connected at one end to said cradle-support structure and extending upwardly with a piston rod pivotally connected to the underside of the cradle frame.

4. A pole-setting apparatus as defined in claim 1 wherein said boom assembly and ground-engaging dolly are interconnected by a releasable connection including a coacting pin and hook for initial locating assembly and a pin and slot for holding the dolly and boom assembly in assembled relation.

5. A pole-setting apparatus comprising, a boom assembly connectable at one end to a ground-engaging dolly, a cradle support structure having a pair of spaced-apart side plates and interconnecting members and rotatably mounting a pair of tires, means defining a first connection of said side plates to another end of said boom assembly, a cradle assembly including a cradle frame pivotally mounted intermediate its ends to said side plates at a distance from said first connection, a hydraulic cylinder positioned between said side plates and pivotally connected at one end to said side plates at a location generally beneath said first connection, said cylinder extending upwardly toward said cradle assembly in the space between said first connection and the pivotal mounting of the cradle frame to the cradle-support structure and having a piston rod pivotally connected to the underside of the cradle frame, said boom assembly including a boom and a torsion bar extended between said boom at said one end of the boom assembly and to a connection to said cradle-support structure, and a tension-setting bolt rotatably attached to said boom and engageable with a bolt step on the cradle-support structure intermediate the connections of the boom and the torsion bar to the cradle-support structure for applying tension to said torsion bar.

6. A pole-setting apparatus comprising, a boom assembly having a boom connectable at one end to a cradle-support structure, a cradle frame for supporting a pole pivotally-mounted on said cradle frame structure, motor means connected between said cradle-support structure and the cradle frame for causing pivotal movement of the cradle frame to raise a pole carried thereby, a dolly with tires associated with the boom at an end thereof remote from the cradle-support structure, and quick-connection means between said boom and dolly including a pair of spaced-apart plates on said dolly, a connecting plate extended from said boom and of a thickness to fit between said spaced-apart plates, a fixed pin extended between said spaced-apart plates, aligned openings in said spaced-apart plates above said pin, a hook formed on said connecting plate to engage over said pin, an opening in said connecting plate to align with said aligned openings, and a removable pin extended through said openings, at least one of said openings being elongate in a direction generally normal to a radian from said fixed pin to facilitate alignment of the openings for receipt of the removable pin and permit slight pivoting of the dolly relative to the boom.

7. An apparatus as defined in claim 6 wherein said quick-connection means are offset from an axle for the dolly tires whereby the dolly may be tilted during raising of the pole.

* * * * *